US006131745A

United States Patent [19]

Baker, Jr.

[11] Patent Number: 6,131,745

[45] Date of Patent: Oct. 17, 2000

[54] DISPLAY APPARATUS

[75] Inventor: Russell H. Baker, Jr., North Attleboro, Mass.

[73] Assignee: Fada Industries, Inc., Long Island City, N.Y.

[21] Appl. No.: 09/219,281

[22] Filed: Dec. 22, 1998

[51] Int. Cl.[7] ..... A47F 5/00

[52] U.S. Cl. ..... 211/13.1; 211/128.1; 211/129.1

[58] Field of Search ..... 211/128.1, 205, 211/85.2, 78, 46, 85.17, 129.1, 144, 163, 13.1

[56] References Cited

U.S. PATENT DOCUMENTS

| | | | |
|---|---|---|---|
| 226,645 | 4/1880 | Albaugh | 211/129.1 |
| 2,286,831 | 6/1942 | Ressinger | 211/85.17 |
| 2,893,566 | 7/1959 | Shenker | 211/129.1 |
| 3,984,002 | 10/1976 | Howard | 211/45 |
| 4,534,474 | 8/1985 | Ng | 211/129.1 X |
| 5,894,944 | 4/1999 | Swift | 211/128.1 X |

FOREIGN PATENT DOCUMENTS

| | | | |
|---|---|---|---|
| 272845 | 4/1951 | Switzerland | 211/129.1 |

*Primary Examiner*—Robert W. Gibson, Jr.
*Attorney, Agent, or Firm*—Schweitzer Cornman Gross & Bondell LLP

[57] ABSTRACT

A display apparatus having particular utility for the presentation of small articles, such as watches, is intended to be mounted on department store rounders utilized for the presentation of related products, such as soft goods. The display apparatus has a central aperture in which display indicia may be installed. A tiered product display area surrounds the central aperture. Clamps are provided to retain the display apparatus upon a peripheral rail of the rounder display.

8 Claims, 4 Drawing Sheets

DISPLAY APPARATUS

The present invention relates to a new and improved display apparatus intended to be used in a retail marketing environment, particularly adapted to allow goods of a first character to be displayed in conjunction with displays of other goods.

BACKGROUND OF THE INVENTION

The presentation of goods in a retail store environment is important for the effective sale thereof. An attractive and efficient display of product is vital for the product to be seen and appreciated by the purchaser. Because of the ever increasing number and variety of goods offered for sale, however, there can be great competition for display space, and thus there is not always the opportunity for the goods of a particular manufacturer or distributor to be presented effectively or completely. Further, with the development and promotion of a variety of goods under the same or complimentary trademarks or trade names, there is often a desire to such related goods in an integrated display which presents both types of goods to their advantage. This is often difficult to achieve with conventional display systems, particularly when display space is at a premium.

A typical form of display for apparel is the free-standing "rounder", a display rack having a circular bar about its periphery upon which hangers bearing product are arranged. Small items such as jewelry and particularly watches are typically displayed in a substantially different environment. The watch boxes are typically stacked on a shelf or a display cabinet. Although such items, including watches, may be desired to be presented in association with clothing items, such as when they are both products of the same manufacturer or designer, it has heretofore been difficult to provide an integrated display which allows both such products to be presented together.

It is accordingly a purpose of the present invention to provide a display apparatus which advantageously is particularly adapted for the display of watches and similar small items which may be used in conjunction with display apparatus for other products to form a unified means of presentation.

It is further a purpose of the present invention to provide such a type of display apparatus which may be utilized in conjunction with display rounders.

Still a further purpose of the present invention is to provide a display apparatus of the aforementioned character which allows the presentation of watches and other small items in a pleasing manner, and which allows the placement of interchangeable display material in association therewith.

Yet another purpose of the present invention is to provide a display apparatus which is capable of utilizing space otherwise not used for display purposes, thus increasing the efficiency of space utilization in a retail store environment.

BRIEF DESCRIPTION OF THE INVENTION

In accordance with the foregoing and other objects and purposes, a display apparatus of the present invention comprises a tiered display segmented and partitioned into individual compartments, each of which is dimensioned to receive a displayed product, such as a watch box. The tiered display includes support means adapted and dimensioned to be mounted upon an upper surface of a second product display apparatus. In a preferred embodiment, the second display apparatus is a display rounder. The support means include means to affix the display upon the second display.

BRIEF DESCRIPTION OF THE DRAWINGS

A fuller understanding of the present invention will be achieved upon review of the following detailed description of a preferred, but nonetheless illustrative embodiment of the invention, when taken in conjunction with the annexed drawing, wherein.

DETAILED DESCRIPTION OF THE INVENTION

Figure 1:
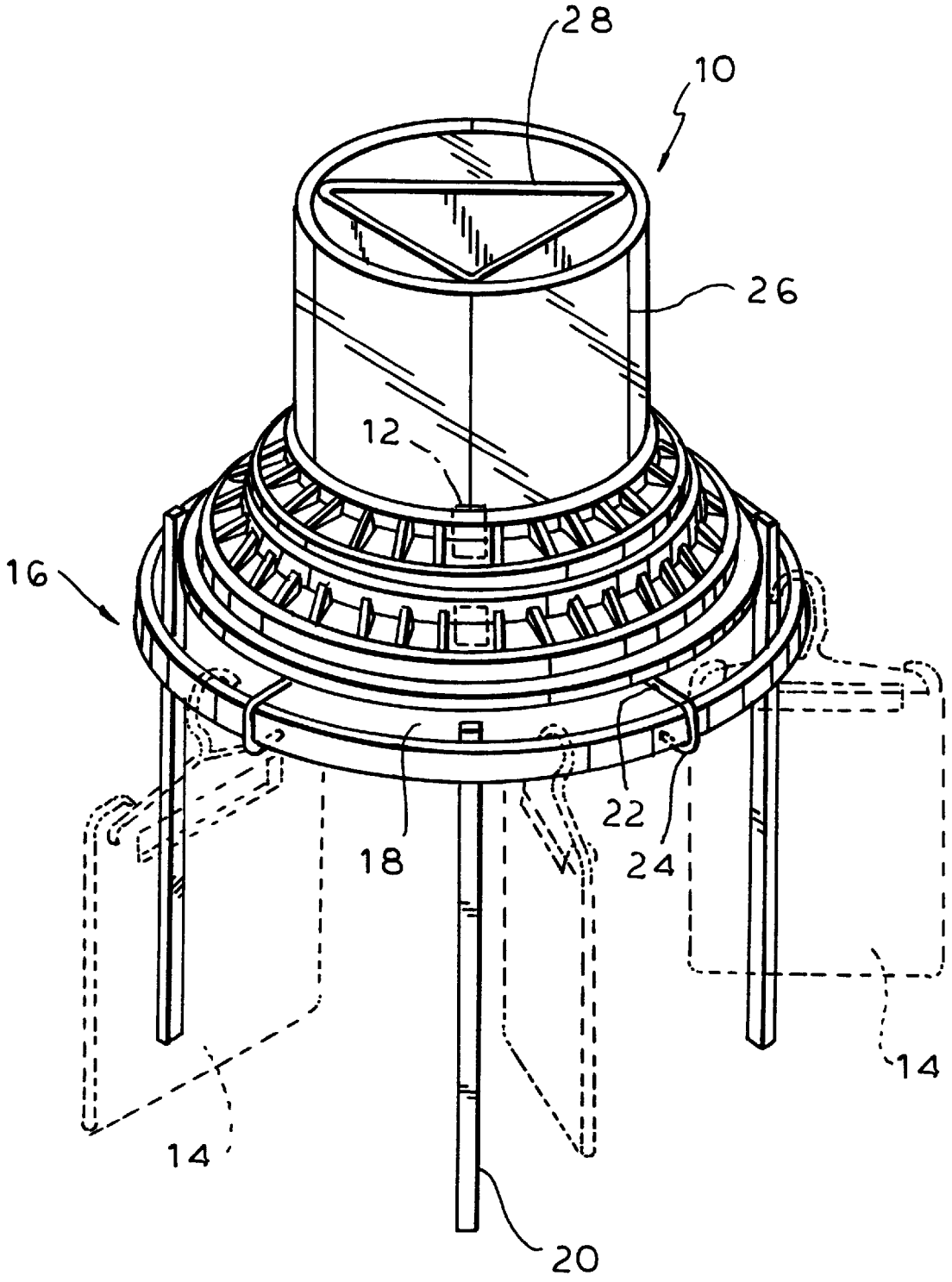
FIG. 1 is a perspective view of the display apparatus of the present invention shown mounted on a display rounder.

Referring initially to FIG. 1, display apparatus 10 of the present invention provides for a of products, such as watches in display boxes 12, in a tiered, circular arrangement in conjunction with the display of other goods, such as hanging garments 14 presented and arrayed on a display rounder 16. Rounder 16 typically comprises a circular rail 18 from which hangers bearing the goods 14 depend, the circular rail being supported by a plurality of legs 20. Display apparatus 10 utilizes the otherwise wasted area above and within the circumference of the circular rail 18 to provide a display environment for the goods presented thereon. The display apparatus 10 is mounted and supported upon the rail 18 by a series of arms 22, the distal ends of which are provided with an in-turned hook which engages and embraces the rail 18. The central portion of the display includes a vertical wall which defines an aperture in which a cylindrical display unit is positioned. The display unit may comprise a transparent cylinder 26 supporting within its interior a multi-sided panel 28 upon which promotional indicia is placed. The indicia on the panel may be seen through the transparent cylinder's side wall.

Figure 2:
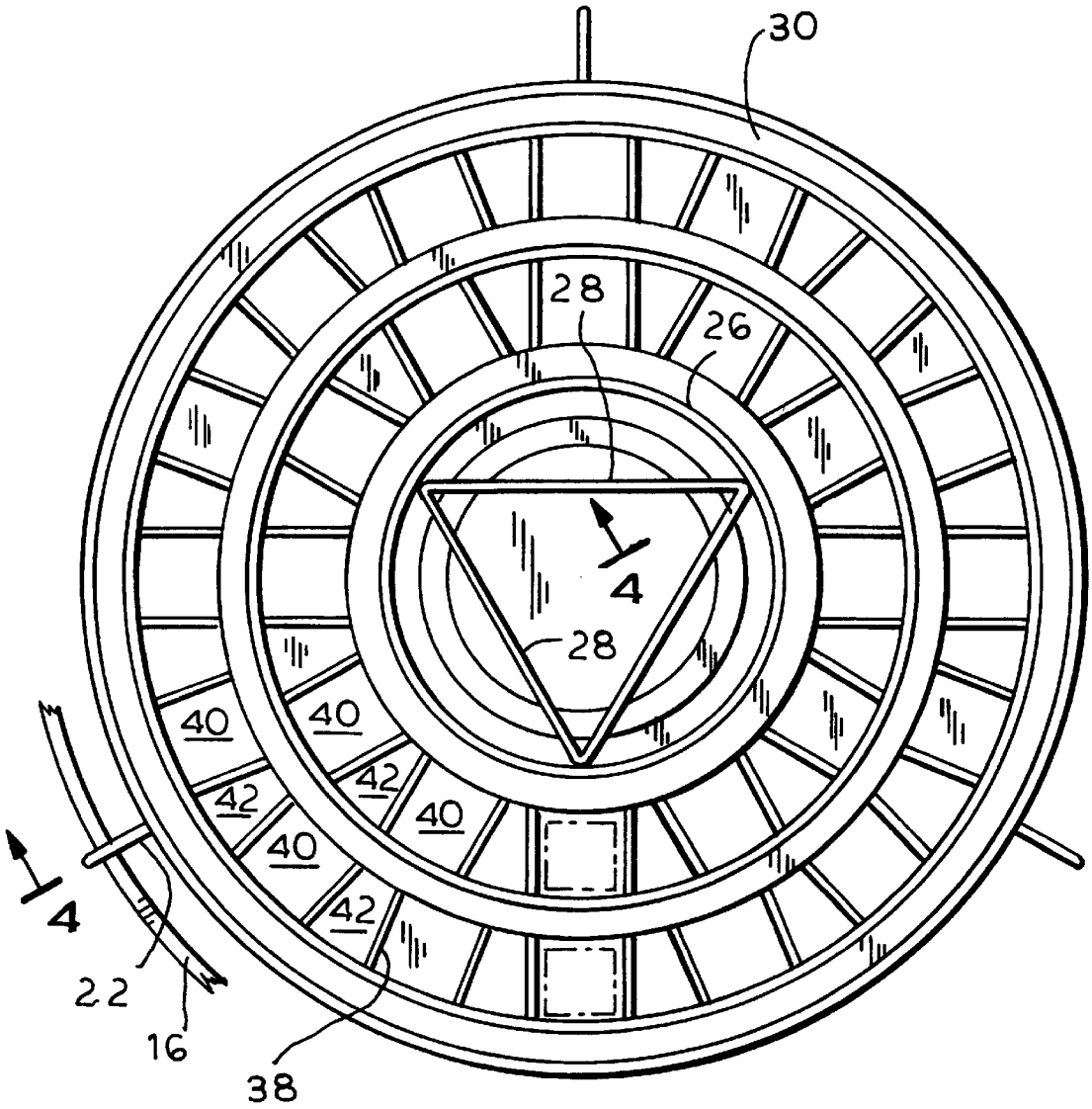
FIG. 2 is a top plan view thereof.
Figure 4:
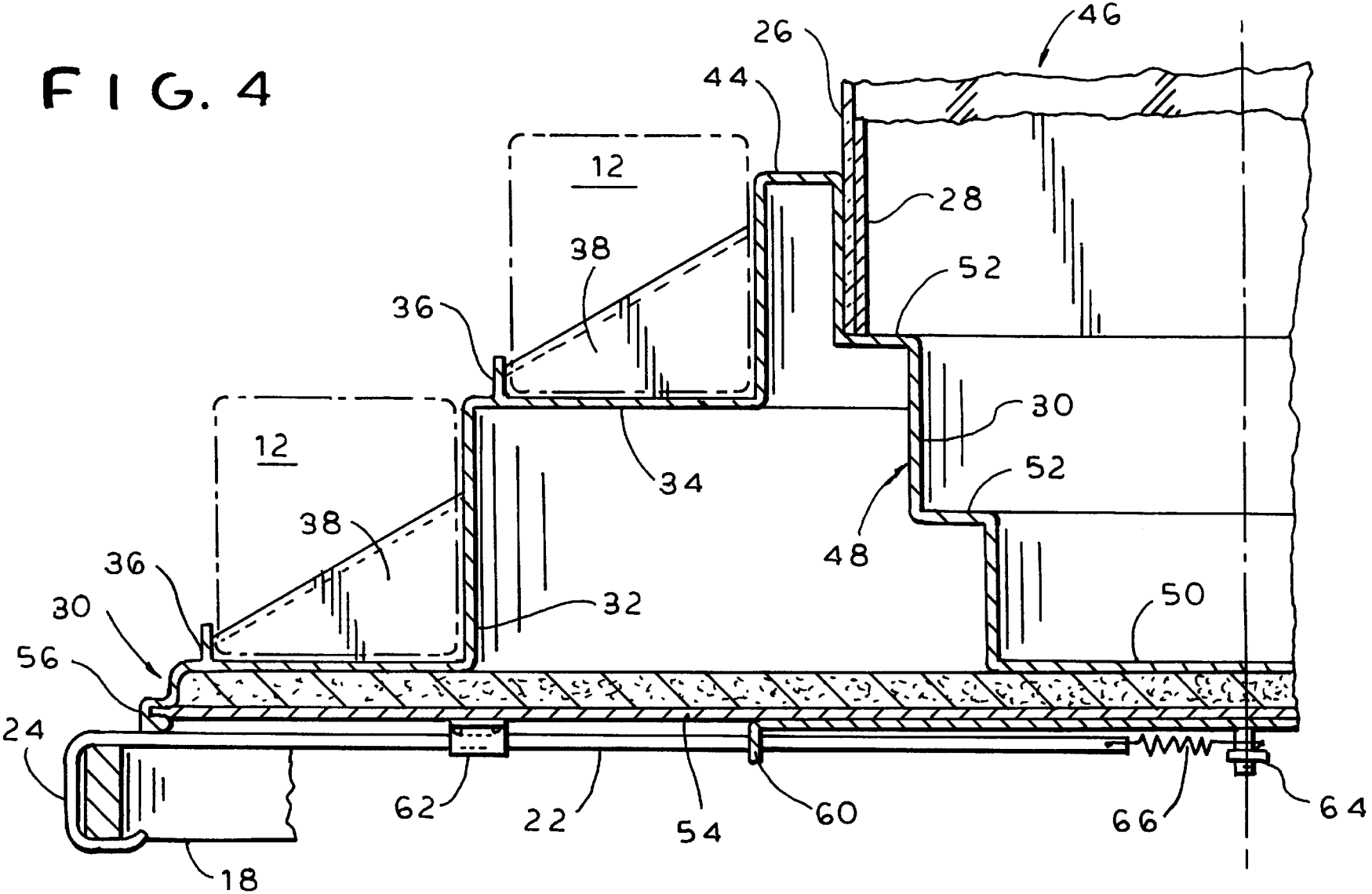
FIG. 4 is a partial elevation view taken in section along line 4—4 of FIG. 2.

With reference to FIGS. 2 and 4, the display apparatus 10 ray comprise a molded piece 30 having a multiple step construction detailed in FIG. 4. As shown therein, the molded piece, which may be formed of an appropriate plastic, forms the support structure for the displayed and arrayed boxes 12 and comprises first and second exterior right-angled step portions 32, 34, each of which form a circular shelf upon which the display boxes 12 may be arrayed. Each of the horizontal portions of the steps 32, 34 may be provided with a frontal lip 36; triangular dividers extending generally radially between the lips and the rear vertical portions of the steps divide the steps into compartments. As seen in FIG. 2, because of the annular or ring shape of the horizontal portions of the steps, the radial triangular walls 38 are located to define, in addition to the areas 40 into which the display boxes 12 can be placed, generally triangular intermediate sections 42. Although both the frontal lips and vertical step portions are circular in plan, the compartments 40 formed may be considered to be generally rectangular, sized to accommodate the boxes 12 without significant misalignment.

With further reference to FIG. 4, the molded piece 30 further includes an annular top wall 44 which surrounds a central compartment or cavity 46. As shown, the central cavity may have a stepped side wall 48 terminating at bottom wall 50. The topmost horizontal step 52 of side wall 48 may be used to support the display cylinder 26 as well as the multi-faceted display panel. 28 located therein. A circular bottom panel 54, which may also be formed of an appropriate plastic, is joined to molded piece 30 about their peripheries at 56.

Figure 3:
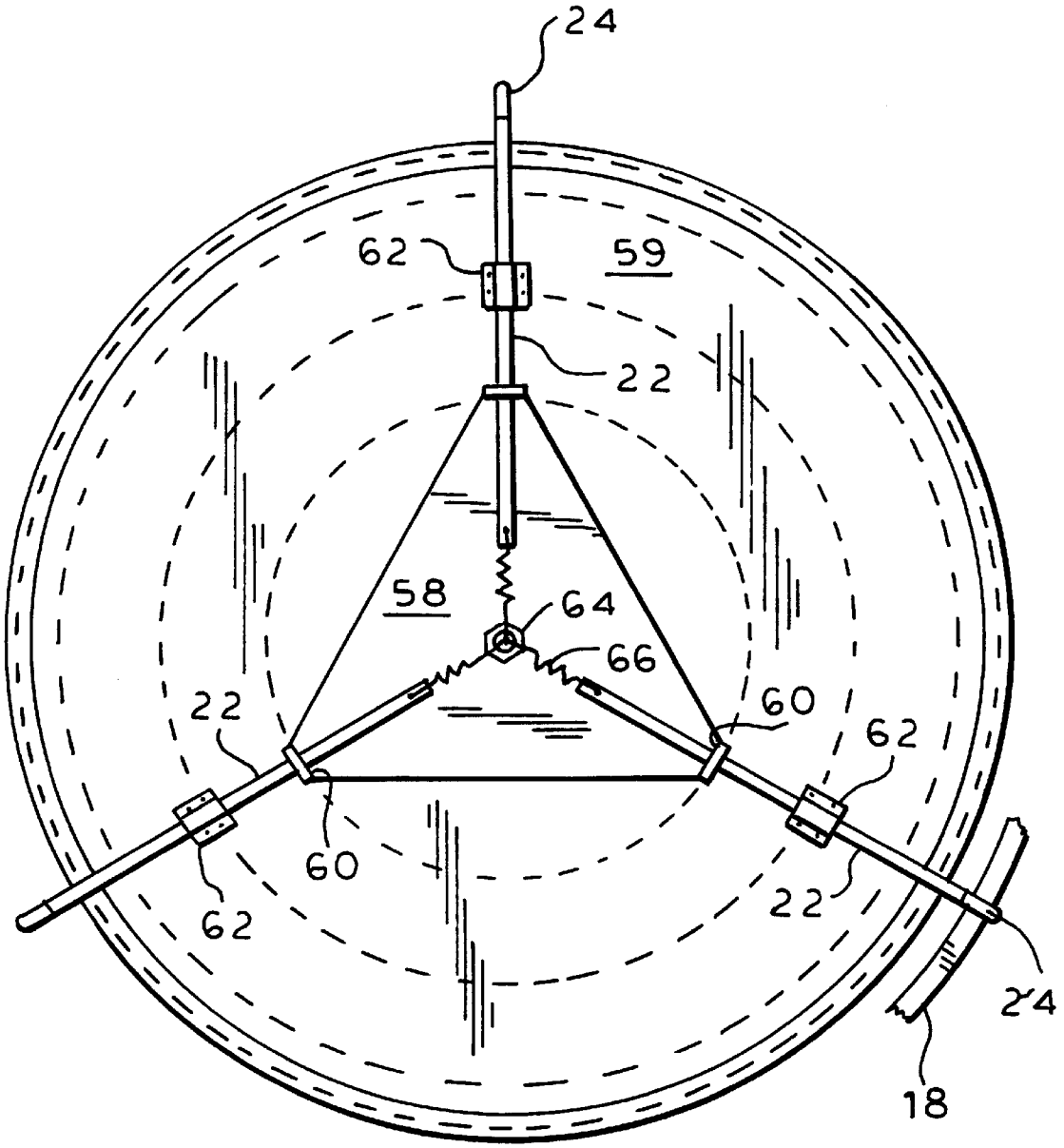
FIG. 3 is a bottom plan view thereof.

A clamp system, as seen in FIGS. 3 and 4, permit the display apparatus 10 to be mounted upon the rounder 16. As presented therein, three radially-extending arms 22, terminating in down-turned hook portions 24 dimensioned to engage the rounder circular rail 18, are mounted upon the lower surface of bottom panel 54. Triangular central guide and support element 58 is affixed to the bottom panel, and includes right-angle portions 60 each having a throughbore through which an arm 22 extends. U-shaped brackets 62, similarly mounted to the bottom panel 54, provide further support and guidance for the arms. The arms are tethered to a central mount 64 of guide and support 58 by springs 66 which urge the arms inwardly, allowing the hook ends to be maintained about the circular rounder rail 18. The arms 22, central guide and support 58 and brackets 62 may be made of metal, such as aluminum or steel. The arms can be manually urged outwardly, against the applied spring force, beyond an engagement position with the rounder rail to engage or disengage the hooks from the rounder upon installation and removal.

It may be appreciated by those skilled in the art that adaptations, modifications and adjustments to the invention as particularly set forth herein may be achieved without departing from the true scope of the invention. Accordingly, such scope is to be measured by the annexed claims.

I claim:

1. Display apparatus, comprising a central wall defining a central aperture for the mounting of display indicia;

product display means in a tiered arrangement in first and second tiers in a stepped arrangement surrounding said central wall; and a plurality of spring-biased clamps for mounting the display apparatus upon a peripheral rail of a second display apparatus.

2. The display apparatus of claim 1 wherein said clamps each comprise a spring-loaded arm having a hook at a distal end thereof adapted to grip the peripheral rail.

3. Display apparatus for the presentation of boxed items in conjunction with other items displayed on a rounder having a peripheral hanger rail, comprising a base;

clamp means mounted to a bottom surface of said base and extending outwardly therefrom to support said display apparatus upon the hanger rail;

individual receptacles for accepting the boxed items arrayed in tiers upon said base; said individual receptacles surrounding a central, upwardly-extending aperture, said central aperture being dimensioned and adapted to accept display indicia projecting upwardly from said aperture.

4. The display apparatus of claim 3, wherein said central aperture has a peripheral side wall.

5. The display apparatus of claim 4, wherein said peripheral side wall is of a stepped configuration.

6. The display apparatus of claim 3, wherein said clamp means comprise a plurality of arms each having a hook at a distal end thereof to engage the hanger rail.

7. The display apparatus of claim 6, wherein said arms are spring biased.

8. Display apparatus, comprising a central wall defining a central aperture for the mounting of display indicia;

an upstanding clear cylinder mounted within said central aperture, said display indicia being inserted therein;

product display means in a tiered arrangement surrounding said central wall; and means for mounting the display apparatus upon a peripheral rail of a second display apparatus.

* * * * *